US006208088B1

(12) United States Patent
Konishi et al.

(10) Patent No.: US 6,208,088 B1
(45) Date of Patent: Mar. 27, 2001

(54) METHOD AND BALLAST FOR STARTING A DISCHARGE LAMP

(75) Inventors: Hirofumi Konishi, Hirakata; Toshiaki Nakamura, Kadoma; Kazunori Kidera, Matsubara, all of (JP)

(73) Assignee: Matsushita Electric Works, Ltd., Kadoma (JP)

( * ) Notice: Subject to any disclaimer, the term of this patent is extended or adjusted under 35 U.S.C. 154(b) by 0 days.

(21) Appl. No.: 09/500,542

(22) Filed: Feb. 9, 2000

(30) Foreign Application Priority Data

Feb. 15, 1999 (JP) ..... 11-036484

(51) Int. Cl.[7] ..... G05F 1/00

(52) U.S. Cl. ..... 315/291; 315/307; 315/360; 315/DIG. 2; 315/DIG. 7

(58) Field of Search ..... 315/291, 299, 315/302, 307, 360, DIG. 2, DIG. 5, DIG. 7

(56) References Cited

U.S. PATENT DOCUMENTS

| | | | | |
|---|---|---|---|---|
| 5,049,790 | * | 9/1991 | Herfurth et al. | 315/291 |
| 5,212,428 | | 5/1993 | Sasaki et al. | 315/308 |
| 5,442,261 | * | 8/1995 | Bank et al. | 315/360 |
| 5,680,015 | * | 10/1997 | Bernitz et al. | 315/307 |
| 5,806,055 | * | 9/1998 | Zinda, Jr. | 315/360 |
| 5,828,187 | * | 10/1998 | Fischer | 315/DIG. 5 |
| 6,040,661 | * | 3/2000 | Bogdan | 315/291 |
| 6,069,457 | * | 5/2000 | Bogdan | 315/360 |
| 6,124,681 | * | 9/2000 | Choi | 315/291 |
| 6,133,697 | * | 10/2000 | Nagai et al. | 315/291 |
| 6,137,240 | * | 10/2000 | Bogdan | 315/307 |
| 6,140,779 | * | 10/2000 | Kanazawa et al. | 315/291 |

FOREIGN PATENT DOCUMENTS

| | | |
|---|---|---|
| 4-141988 | 5/1992 | (JP) . |
| 9-082480 | 3/1997 | (JP) . |

* cited by examiner

*Primary Examiner*—Haissa Philogene
*Assistant Examiner*—Thuy Vinh Tran
(74) *Attorney, Agent, or Firm*—Oblon, Spivak, McClelland, Maier & Neustadt, P.C.

(57) ABSTRACT

A method and a ballast for starting a discharge lamp capable of making a rapid start while restraining the overshoot of the light output. The ballast can separately give the initial start time period of applying a maximum power rating to the lamp and the subsequent curve along which the power decreases to a normal power rating of the lamp. A power is varied along a particular run-up curve so as to apply the maximum power rating and subsequently apply the power decreasing to the normal power rating. The run-up curve is derived from a reference curve having a power level decreasing with time. The reference curve has a maximum value above the maximum power rating, and has an inflection point near the maximum power rating to define first and second reference curves above and below the inflection point, respectively. The first reference curve has a first average slope for a first time period from a point of the maximum value to the inflection point. The second reference curve has a second average slope for a second time period which starts from the inflection point and has the same length as the first time period. The second average slope is greater than the first average slope. The run-up curve is a continuous composite curve of the maximum power rating defined by a portion thereof below the reference curve and the remainder of the reference curve defined between the maximum power rating and the normal power rating.

18 Claims, 10 Drawing Sheets

METHOD AND BALLAST FOR STARTING A DISCHARGE LAMP

BACKGROUND OF THE INVENTION

1. Field of the Invention

The present invention is directed to a method and a ballast for starting a discharge lamp, particularly a high intensity discharge lamp (HID) such as a metal halide lamp.

2. Description of the Prior Art

HID lamps are known to be slow in reaching a stable operation of emitting a destined light output when starting the lamp at a cold state. Particularly, when the lamp is used for a vehicular headlamp or a light source for an LCD projector, it is highly desired to enable a cold start with prompt rise in the light output. To this end, Japanese Patent Laid-open Publication Nos. 4-141988 and 9-82480 propose a ballast which provides, at the start of the lamp, a run-up power greater than a normal power rating required for maintaining the operation of lamp. Then, the run-up power is made to decrease with time from a maximum power rating to the normal power rating over a transition period along a particular curve. The curve of the run-up power is derived from a single charging curve of a capacitor, as shown in FIG. 15A, and is represented as a reversal of the charging curve, as shown in FIG. 15B. Since the ballast has a fixed maximum power rating for the discharge lamp, a portion of the run-up power curve above the maximum power rating should be limited to the maximum power rating, resulting a composite curve in which the maximum power rating is maintained for an initial start time period and then decrease with time to the normal power rating. As the initial start time is required to be longer for attaining a more rapid start of the lamp as indicated by solid lines in the above figures relative to those indicated by dotted lines, both curves, i.e., the charging curve and the run-up curve are made more moderate. Thus, the run-up power decreases along a more moderate slope, applying a more amount of power to the lamp during a transition period from the start to the stable lamp operation, resulting in an overshoot of the light output, as shown in FIG. 16. In order to avoid this problem, it is desired to separately control the initial start time and the curve shape in the transition period which cannot be made in the above prior art, thereby decreasing the run-up power along a moderate slope to exclude a possibility of the overshoot in the light output.

SUMMARY OF THE INVENTION

In view of the above problem, the present invention has been accomplished to provide a method and a ballast for starting a discharge lamp which is capable of making a rapid start while restraining the overshoot of the light output. More specifically, the present invention enables to separately give the initial start time period of applying a maximum power rating to the lamp and the subsequent curve along which the power decreases to a normal power rating of the lamp in an optimized manner. The method in accordance with the present invention utilizes a ballast having a power converter capable of varying a power being applied to the discharge lamp within a range between the maximum power rating given to the lamp and the normal power rating given to the lamp. The method comprises varying the power along a particular run-up curve so as to apply the maximum power rating and subsequently apply the power decreasing to the normal power rating. The run-up curve is derived from a reference curve having a power level decreasing with time from the energization of the ballast. The reference curve has a maximum value exceeding the maximum power rating, and has an inflection point near the maximum power rating so as to define a first reference curve above the inflection point and a second reference curve below the inflection point, respectively. The first reference curve has a first average slope for a first reference time period from a point of the maximum value to the inflection point. The second reference curve has a second average slope for a second reference time period which starts from the inflection point and lasts for the same time interval as the first reference time period. The second average slope is greater than the first average slope. The run-up curve is a continuous composite curve of a straight line of the maximum power rating defined by a portion thereof below the reference curve and the remainder of the reference curve defined between the maximum power rating and the normal power rating. Thus, the initial start time period defined by the straight line of the run-up curve can be determined by the first reference curve, while the subsequent curve along which the power decreases to the normal power rating can be determined substantially by the second reference curve below the inflection point. With this result, the initial start time and the subsequent curve can be designed separately from each other in order to give a sufficient initial start time period for rapid start of the lamp and at the same time to give an optimum configuration to the subsequent curve for assuring a stable transition from the start to the normal operation of the lamp without causing an overshoot or insufficient light output. Accordingly, it is a primary object of t e present invention to provide a method of starting the discharge lamp with an optimum power characteristic to enable a rapid start with sufficient light output.

Most preferably, the inflection point is set to lie on the maximum power rating so that the second reference curve can defines itself the decreasing curve of applying the decreasing power to the discharge lamp after the initial start time period.

The present invention also provides the ballast which is specifically designed to realize the above method. The ballast includes a power converter capable of applying a varying power to discharge lamp, and a power commander which generates the run-up curve of the power with reference to time and is connected to the power converter to vary the power along the run-up curve.

Preferably, the power commander includes a function generator having a capacitor, a power source and a regulator for charging the capacitor by the power source at different rates to give a charging curve. The reference curve is obtained as a reversal of the charging curve so that the inflection point is given on the reference curve where the charging rate changes critically.

As will be seen in the detailed description of the embodiments of the present invention, various and advantageous configurations are made for the function generator to obtain the inflection point on the reference curve. These and still other object and advantageous features of the present invention will become more apparent from the following description of the embodiments when taken in conjunction with the attached drawings.

DETAILED DESCRIPTION OF THE EMBODIMENTS

Figure 1:
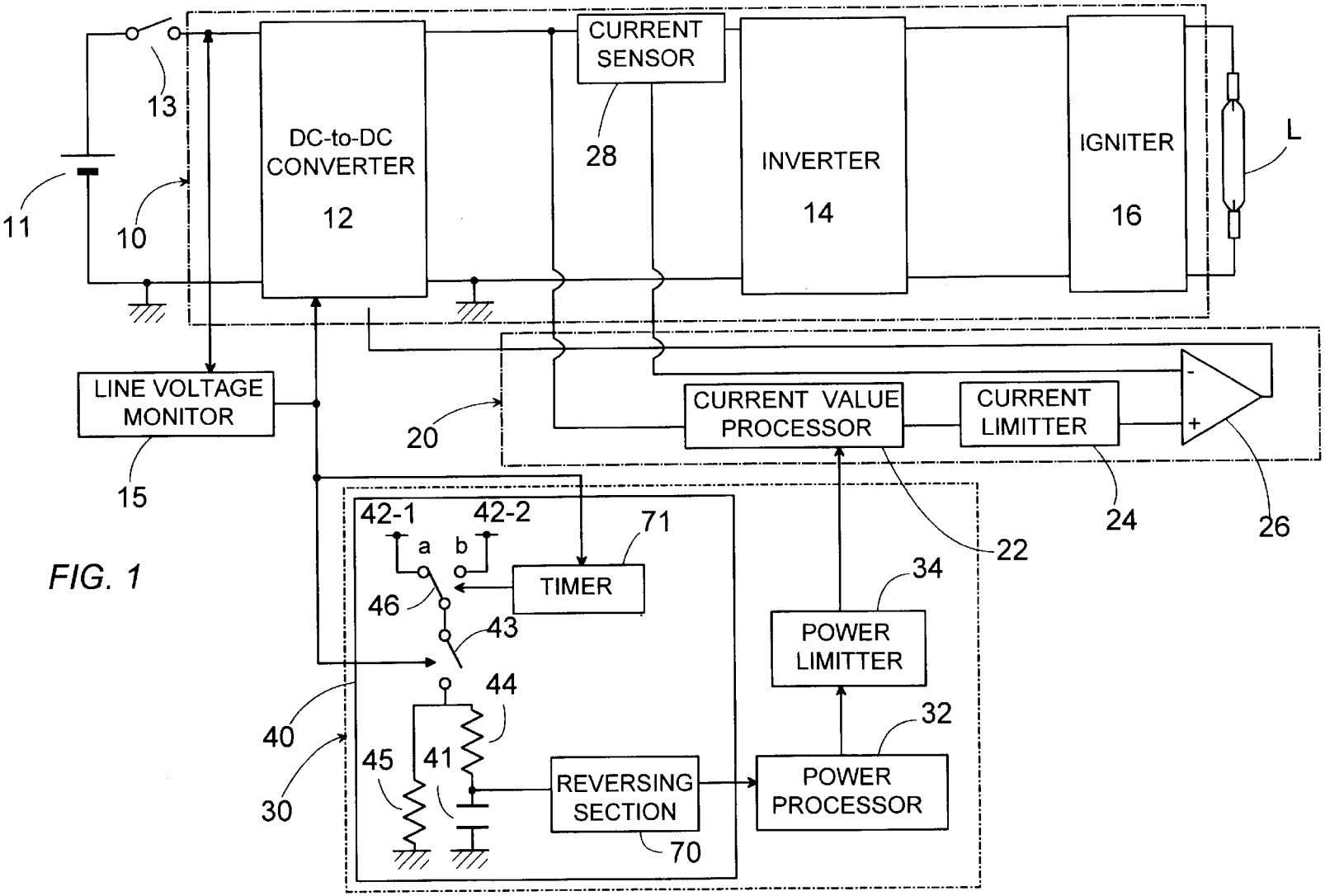
FIG. 1 is a block diagram of a ballast in accordance with a first embodiment of the present invention.

First Embodiment <FIGS. 1 to 3>

Referring now to FIG. 1, there is shown a ballast for a discharge lamp in accordance with a first embodiment of the present invention. The discharge lamp L is high-intensity discharge lamp such as a metal halide lamp in use, for example, a headlamp of an automobile and a light source for LCD projector. The ballast is required to give a maximum power rating for starting the lamp and a normal power rating for continuously operating the lamp based upon the specification of the discharge lamp.

The ballast includes a power converter 10, an output controller 20, and a power commander 30. The power converter 10 includes a DC-to-DC converter 12 providing an raised DC voltage from a DC source 11 such as a battery, and an inverter 14 providing a low frequency AC voltage to the discharge lamp L through an igniter 16. The igniter 16 generates from the output of the inverter a high voltage pulse sufficient for igniting the lamp. The output controller 20 is connected to monitor a voltage and current in the power converter 10 to control a lighting operation of the lamp in a feedback manner. The output controller 20 includes a current value processor 22 which detects an output voltage of the DC-to-DC converter 12 and receives a power command from the power commander 30 designating a power of operating the lamp. Then, the current value processor 22 acts to divide the power by the detected voltage to provide a current request to an error amplifier 26 through a current limiter 24 where an excessive current request is neglected. The error amplifier 26 compares the current request with a current detected by a current sensor 28 to flow into the inverter 14, and provides an output control signal indicative of the compared result. The output control signal is fed back to regulate the DC-to-DC converter 12 in such a manner as to assure a stable operation of the lamp.

Figure 2A:
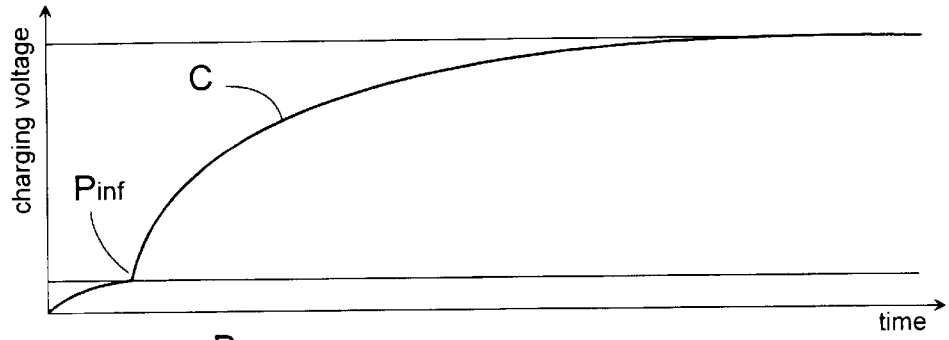
FIG. 2A is a graph of a capacitor charging curve obtained in the above ballast.

The power commander 30 is responsible for providing to the current value processor 22 the power command designating the power varying from the maximum power rating down to the normal power rating. The power command is provided in the form of a combination of a run-up curve $C_{IGN}$ and a straight line $L_{NOR}$ indicative of the normal power rating, as indicated by solid lines in FIG. 2B. The power commander 30 includes a function generator 40 which provides a power curve to the power processor 32 where an offset value of the normal power rating is added or superimposed to the power curve to give a reference curve $C_{REF}$ as will be discussed later in detail with reference to FIG. 2B. Thus superimposed curve or the reference curve $C_{REF}$ is subsequently fed to a power limiter 34 where the maximum of the reference curve $C_{REF}$ is limited to the maximum power rating $W_{MAX}$ to give the power command to be supplied to the current value processor 22. The function generator 40 has a capacitor 41 and a variable voltage source composed of a first voltage source 42-1 and a second voltage source 42-2 for charging the capacitor 41 at different rates to give a charging curve C as shown in FIG. 2A. The charging curve C is then inverted or reversed at a reversing section 70 to provide the power curve to the power processor 32 where it is shaped into the reference curve $C_{REF}$ with the addition of the offset value of the normal power rating $W_{NOR}$.

Figure 2B:
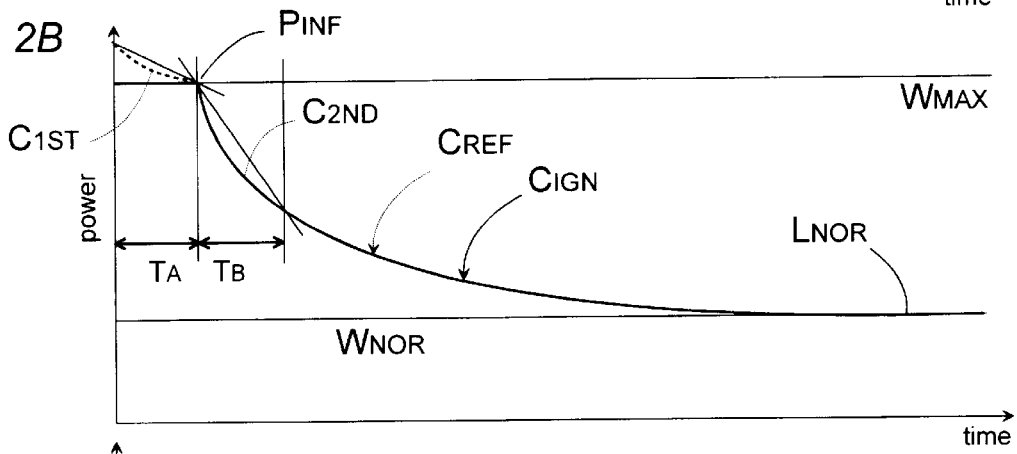
FIG. 2B is a graph illustrating a reference curve and the resulting run-up curve obtained in the above ballast.
Figure 3A:
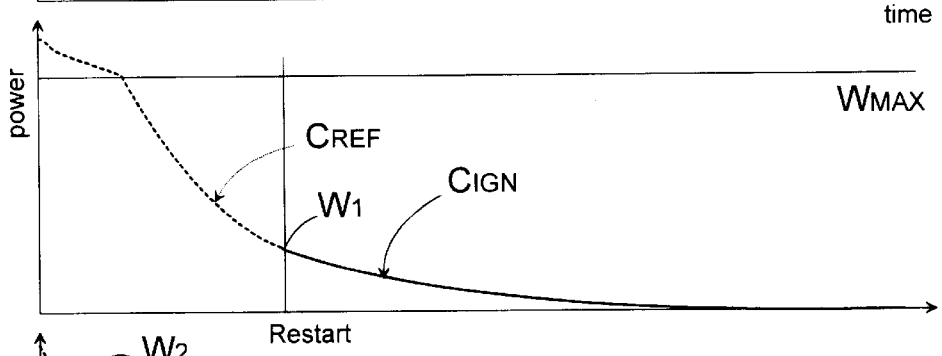
FIGS. 3A to 3C are graphs illustrating the operation of the ballast.
Figure 3B:
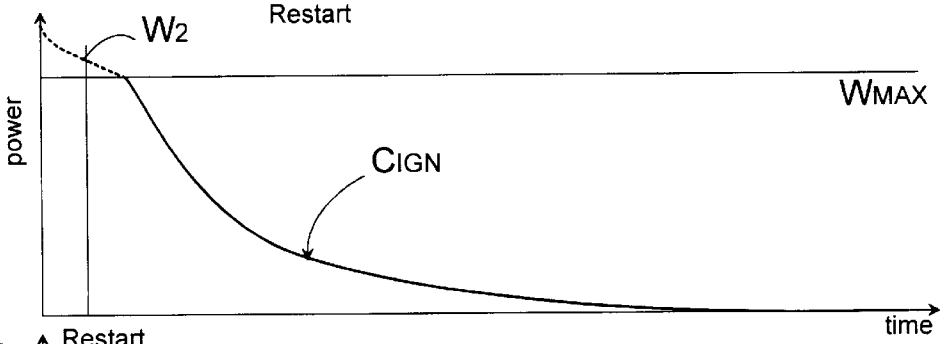

Upon the energization of the ballast which is made by closing a power switch 13, a line voltage monitor 15 responds to issue a lighting enable signal to the DC-to-DC converter 12 as well as to the function generator 40 when the monitored input voltage level is within a predetermined operating voltage range, activating the two components 12 and 40. The lighting enable signal closes a switch 43 to start charging the capacitor 41 through a resistor 44. A timer 71, which is connected to actuate a switch 45 for selectively connecting the first and second voltage sources 42-1 and 42-2 to the capacitor 41, is also activated by the enable signal to start counting time. At first, the timer 71 turns a switch 46 for charging the capacitor 41 by the first voltage source 42-1 and, after the elapse of predetermined period, turns the switch 46 for charging the capacitor 41 by the second voltage source 42-2. The second voltage source 42-2 gives a higher voltage than the first voltage source 42-1, so that the charging curve C sees an inflection point $P_{inf}$ as shown in FIG. 2A at a timing corresponding to the switching of the first voltage source to the second voltage source. Therefore, a corresponding inflection point $P_{INF}$ is given to the resulting reference curve $C_{REF}$, as shown in FIG. 2B, to define a first reference curve $C_{1ST}$ and a second reference curve $C_{2ND}$ above and below the inflection point $P_{INF}$. The inflection point $P_{INF}$ is selected to lie on or near the level of the maximum power rating $W_{MAX}$ so that the run-up curve $C_{IGN}$ is composed of a straight line of the maximum power rating extending over a portion of the first reference curve $C_{1ST}$ above the maximum power rating and the second reference curve $C_{2ND}$. The characteristic of the run-up curve can be represented in terms of an average slope of the curves over particular time periods. That is, the first reference curve $C_{1ST}$ or the portion of the reference curve above the inflection point $P_{INF}$ has a first average slope over a period $T_A$ from the energization of the ballast (time 0) to the inflection point, and the second reference curve $C_{2ND}$ or the portion of the reference curve below the inflection point $P_{INF}$ has a second average slope greater than the first average slope over the same time period $T_B$ starting from the inflection point.

With the provision of the inflection point on the reference curve, the second reference curve of decreasing the power down to the normal power rating can be selected independently of the shape of the first reference curve which determines the period of applying the maximum power rating. Thus, the resulting igniting curve can be optimized, assuring to start the lamp successfully by applying the maximum power rating over a sufficient time period and also to decrease the power to the normal power rating successfully through a transition period from the starting of the lamp to the stable operation of the lamp.

Figure 3C:
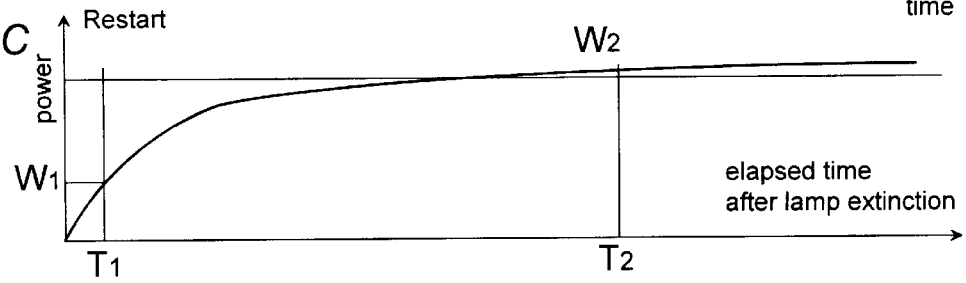

When the power switch 13 is turned off, the line voltage monitor 15 issues a disable signal to inactivate the DC-to-DC converter 12 as well as to open the switch 43, allowing the capacitor 41 to discharge through a discharge path of resistor 44 and resistor 45. The decreasing voltage of the capacitor 41 is indicative of an elapsed time from the extinction of the lamp, i.e., a cooling extent of the lamp such that, when the switch 13 is closed, the voltage of the capacitor 41 gives an initial power setting which increases from zero with the elapsed time, as shown in FIG. 3C. The initial power setting is given to the reversing section 70 to vary the starting point of the decreasing the power on the reference curve $C_{REF}$ as a function of the elapsed time. When the lamp is started short time at time $T_1$ after the extinction, i.e., with some residual heat from the prior operation, the reference curve $C_{REF}$ is modified, as indicated by solid lines in FIG. 3A, to start at the power level corresponding to the initial power setting $W_1$ at time $T_1$ in FIG. 3C. When the lamp is started after a relatively long time $T_2$ elapsed from the lamp extinction, i.e., with less residual heat, the reference curve $C_{REF}$ is modified, as indicated by solid lines in FIG. 3B, to start at the level corresponding to the initial power setting $W_2$ at time $T_2$ in FIG. 3C. In this manner, it is possible to make a successful re-ignition of the lamp in well consideration of the residual heat of the lamp.

Figure 4:
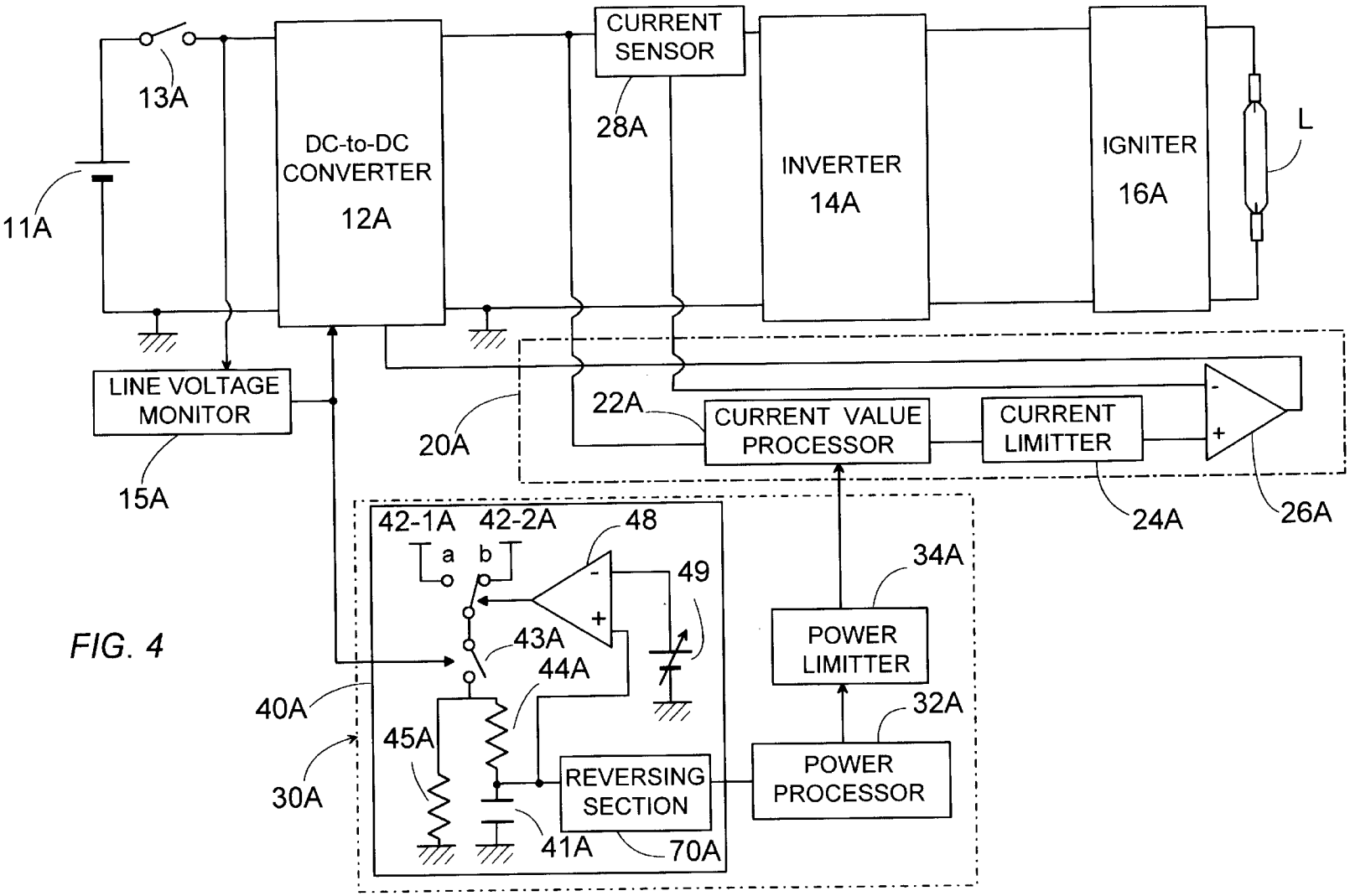
FIG. 4 is a block diagram of a ballast in accordance with a second embodiment of the present invention.

Second Embodiment <FIG. 4>

FIG. 4 illustrates a ballast in accordance with a second embodiment of the present invention which is identical to the first embodiment except for configuration of a function generator 40A. Like parts are designated by like numerals with a suffix letter of "A". The function generator 40A includes a comparator 48 which compares a voltage developed across the capacitor 41A with a reference voltage 49. The comparator 48 is connected to the switch 46A for charging the capacitor from the first voltage source 42-1 when the voltage of capacitor 41A is below the reference voltage 49 and otherwise for charging the capacitor 41A from the second voltage source 42-2, thereby giving the inflection point on the reference curve, as in the first embodiment.

Figure 5:
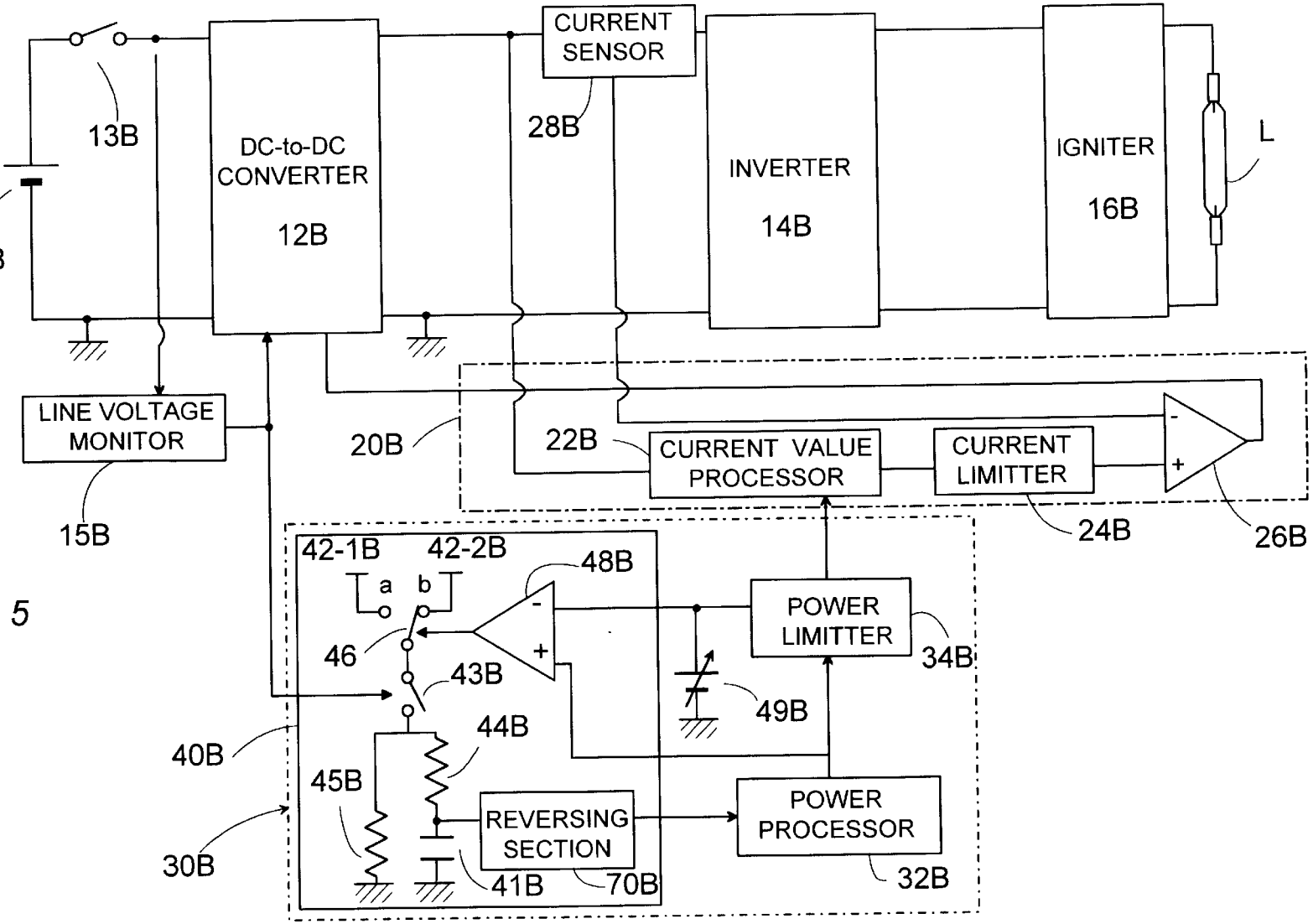
FIG. 5 is a block diagram of a ballast in accordance with a third embodiment of the present invention.

Third Embodiment <FIG. 5>

FIG. 5 illustrates a ballast in accordance with a third embodiment of the present invention which is identical to the first embodiment except for the configuration of a power commander 30B. Like parts are designated by like numerals with a suffix letter of "B". The power commander 30B has a like function generator 40B which includes a comparator 48B is connected to receive the output of the power processor 32B, i.e., the reference curve and to receive the maximum power rating $W_{MAX}$ which is set at a reference voltage source 49 and is given to the power limiter 34B. The comparator 48B has its output connected to a switch 46B so that, while the power level command from the power processor 32B exceeds the maximum power level, the first voltage source 42-1B of low voltage is responsible for charging the capacitor 41B. When the voltage across the capacitor 41B increases to such a level such that the power command on the resulting reference curve from the power processor 32B goes below the maximum power rating $W_{MAX}$, the comparator 48B responds to turn the switch 46B for charging the capacitor 41B by the second voltage source 42-2B at a greater charging rate, thereby giving the inflection point, as seen in FIG. 2B at or adjacent below the maximum power rating. In this manner, the inflection point can be easily given in a feedback manner.

Figure 6:
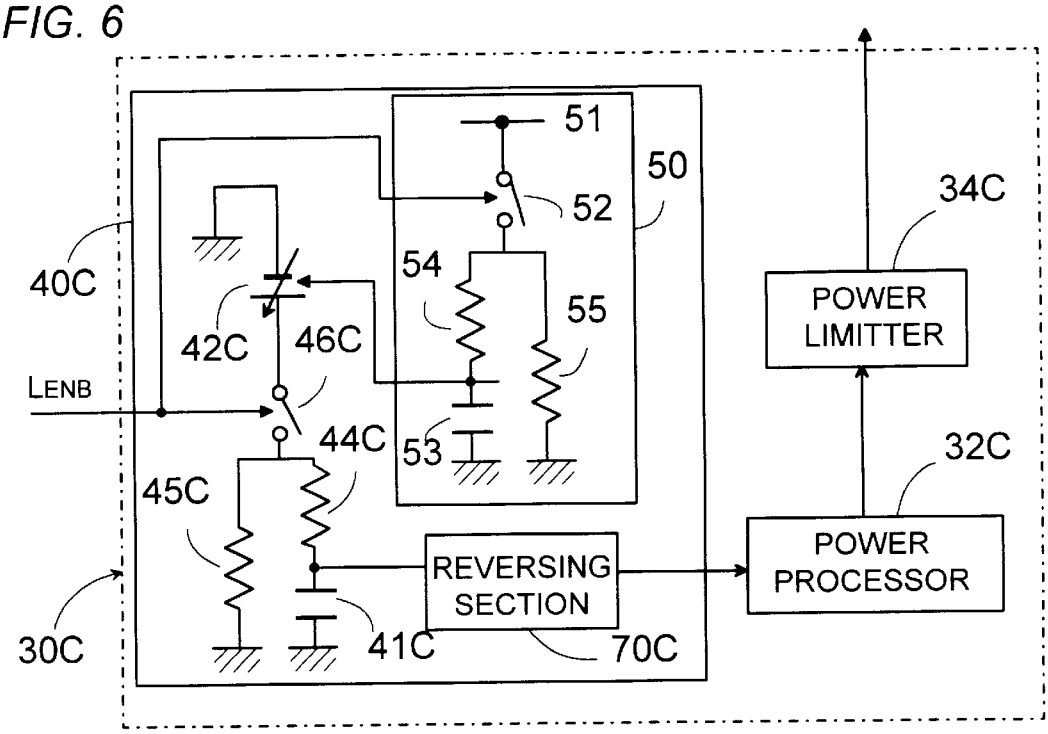
FIG. 6 is a block diagram of a power commander utilized in the ballast in accordance with the fourth embodiment of the present invention.

Fourth Embodiment <FIGS. 6 and 7>

Figure 7A:
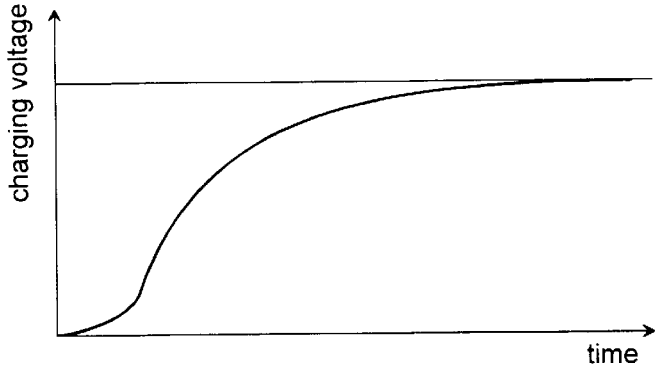
FIG. 7A is a graph of a capacitor charging curve obtained in the ballast of FIG. 6.
Figure 7B:
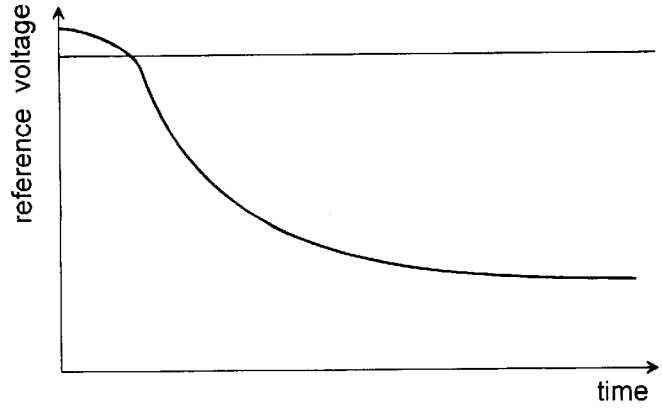
FIG. 7B is a graph illustrating a reference curve and the resulting run-up curve obtained in the ballast.

FIG. 6 illustrates a ballast in accordance with a fourth embodiment of the present invention which is identical to the first embodiment except for the configuration of a function generator 40C. Like parts are designated by like numerals with a suffix letter of "C". The function generator 40C includes a variable power source 42C for charging a capacitor 41C at varying rates. The power source 42C has its output voltage regulated by a time-varying function circuit 50. The circuit 50 includes a fixed voltage source 51 and a switch 52, which is actuated by the lighting enable signal $L_{ENB}$ from a like line voltage monitor (not shown) as in the first embodiment to charge a capacitor 53 through a resistor 54 by the voltage source 51. It is the charged voltage across the capacitor 53 that is responsible for varying the output voltage of the variable power source 42C in such a manner that, as shown in FIG. 7A, the output voltage of the source 42C increases as the charged voltage of capacitor 53 increases. Thus, the circuit 50 functions as a timer which causes the output voltage of the power source 42C to increase gradually from a first level to a second level and to fix at the second level at a predetermined period after the energization of the ballast, i.e., when the voltage across capacitor 53 reaches to a predetermined level. With this result, the reference curve can be given the inflection point at or adjacent the maximum power rating, as shown in FIG. 7B, as a consequence of that the output voltage of capacitor 41C is fixed to the second level. When the lighting enable signal is removed, the switch 52 is opened to allow the capacitor 53 to discharge through resistors 54 and 55, and at the same time, the switch 46B is opened to discharge the capacitor 41C.

Figure 8:
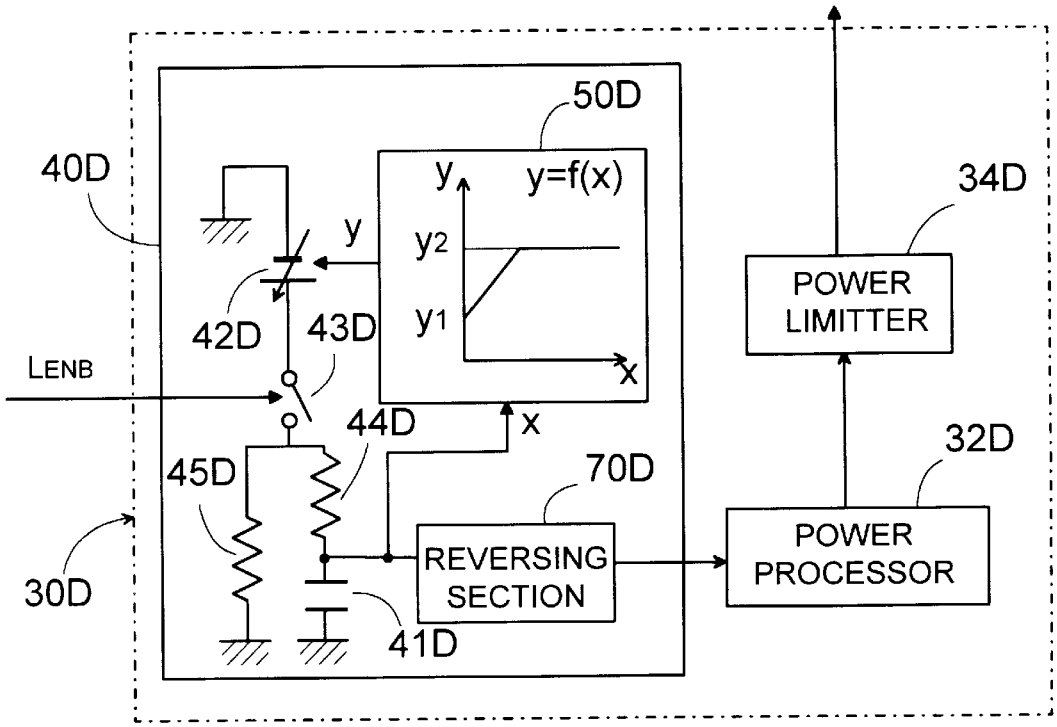
FIG. 8 is a block diagram of a power commander utilized in the ballast in accordance with the fifth embodiment of the present invention.
Figure 9A:
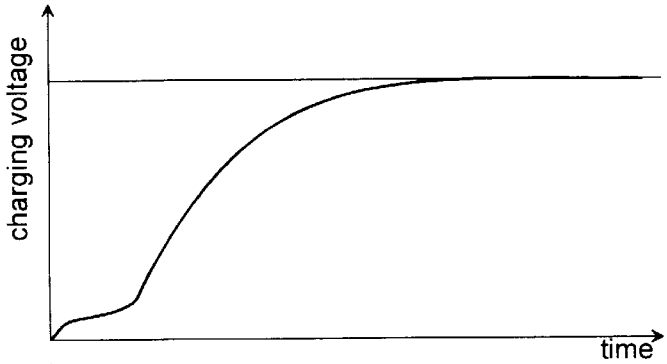
FIG. 9A is a graph of a capacitor charging curve obtained in the ballast of FIG. 8.

Fifth Embodiment <FIGS. 8 and 9>

FIG. 8 illustrates a ballast in accordance with a fifth embodiment of the present invention which is identical to the first embodiment except for the configuration of a function generator 40D. Like parts are designated by like numerals with a suffix letter of "D". The function generator 40D includes a variable voltage source 42D and a time-varying function circuit 50D which is connected to regulate the output voltage of the source 42D based upon the voltage detected to develop across the capacitor 41D. Upon receiving the lighting enable signal $L_{ENB}$, a switch 43D is closed to start charging the capacitor 41D by the voltage source 42D, and at the same the function circuit 50D provides a linearly increasing value as a function of the detected voltage of capacitor 41D.

Figure 9B:
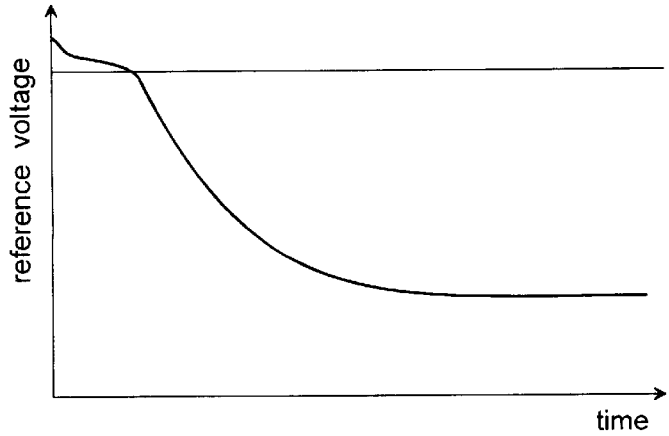
FIG. 9B is a graph illustrating a reference curve and the resulting run-up curve obtained in the ballast.

The function circuit 50D provides a value (y=f(x), where x is the detected capacitor voltage) which increases from a first level (y1) and a second level (y2) as the detected voltage of capacitor 41D increases and is fixed to the second level after the detected voltage reaches a predetermined voltage. The output of the voltage source 42D is regulated as a function of the value such that the capacitor 41D is charged along a charging curve of FIG. 9A and that the inflection point is given on the reference curve, as shown in FIG. 9B, when the output is fixed to the high voltage level after increasing thereto.

Figure 10:
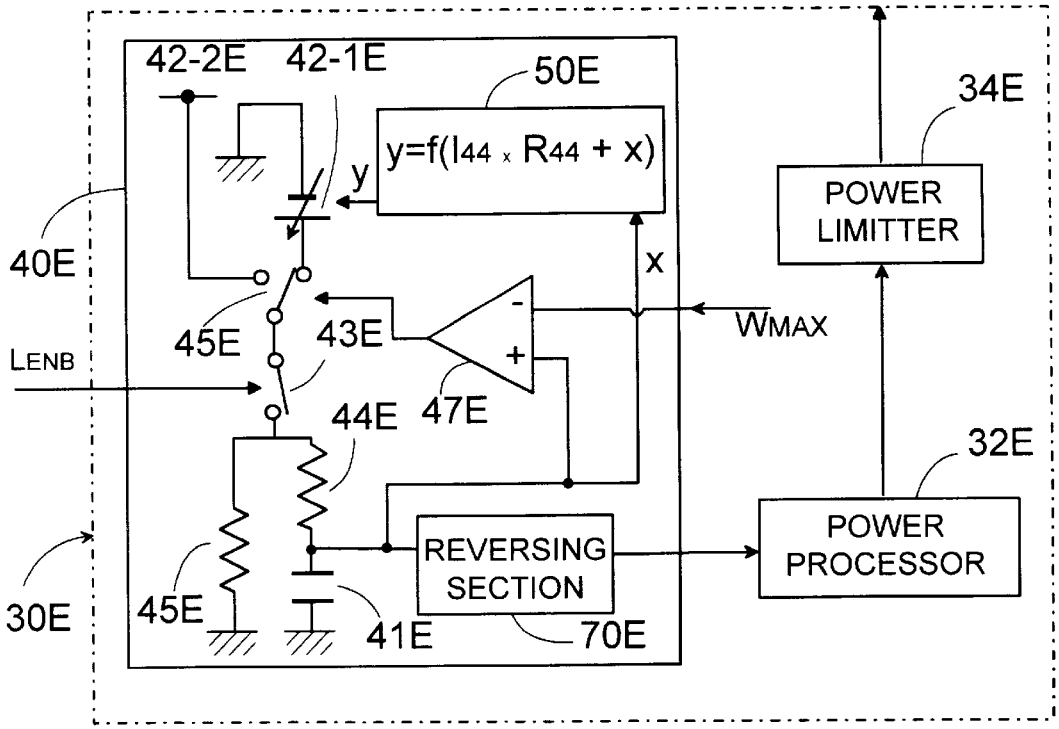
FIG. 10 is a block diagram of a power commander utilized in the ballast in accordance with the sixth embodiment of the present invention.

Sixth Embodiment <FIGS. 10 and 11>

Figure 11A:
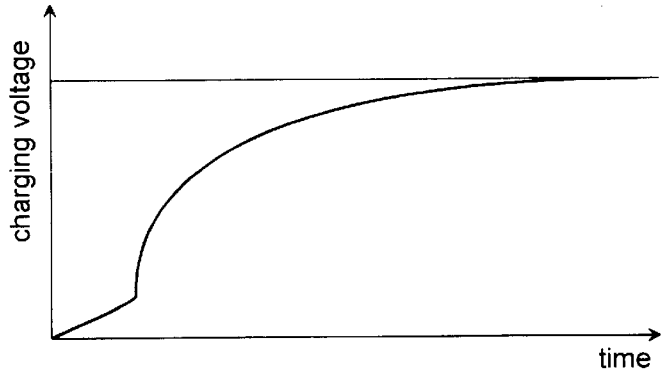
FIG. 11A is a graph of a capacitor charging curve obtained in the ballast of FIG. 10.
Figure 11B:
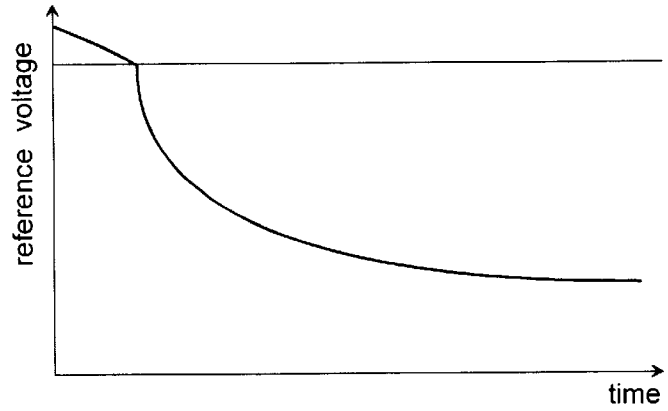
FIG. 11B is a graph illustrating a reference curve and the resulting run-up curve obtained in the ballast.

FIG. 10 illustrates a ballast in accordance with a sixth embodiment of the present invention which is identical to the first embodiment except for the configuration of a function generator 40E. Like parts are designated by like numerals with a suffix letter of "E". The function generator 40E includes a variable power source 42-1E and a fixed voltage source 42-2E which provides a higher output voltage than the variable power source. These voltage sources are selectively connected through a switch 45E to charge a capacitor 41E. The switch 45E is normally turned to a position of connecting the variable voltage source 42-1E to the capacitor 41E, and is controlled to turn to another position of connecting the fixed voltage source 42-2E to the capacitor 41E, by a comparator 47E which compares the voltage detected to develop across the capacitor 41E with a reference voltage corresponding to the maximum power rating $W_{MAX}$ through reversal of the charged voltage, i.e., on the reference curve. Upon receiving the lighting enable signal $L_{ENB}$, a switch 43E is closed to start charging capacitor 41E by the variable voltage source 42-1E. As the capacitor 41E is charged up to a level corresponding to the maximum power rating, the comparator 47E responds to turn the switch 45E to connect the fixed voltage source 42-2E for charging the capacitor 41E. In this manner, the capacitor 41E is continuously charged to have a charging curve, as shown in FIG. 11A, to provide the reference curve of FIG. 11B in which the inflection point is given at or near the maximum power rating. The variable power source 42-1E is regulate to provide the output voltage which is expressed by a function of $y=f(1_{44}\cdot R_{44}+x)$, where $I_{44}$ is a current flowing through resistor 44E, $R_{44}$ is a resistance of resistor 44E, and x is a charged voltage of capacitor 41E. Thus, the voltage of capacitor 41E increases linearly with the increase in the output voltage of variable power source 42-1E, as shown in FIG. 11A. With this result, the time period of applying the maximum power rating can be easily set simply by selecting a slope of the linear function.

Figure 12:
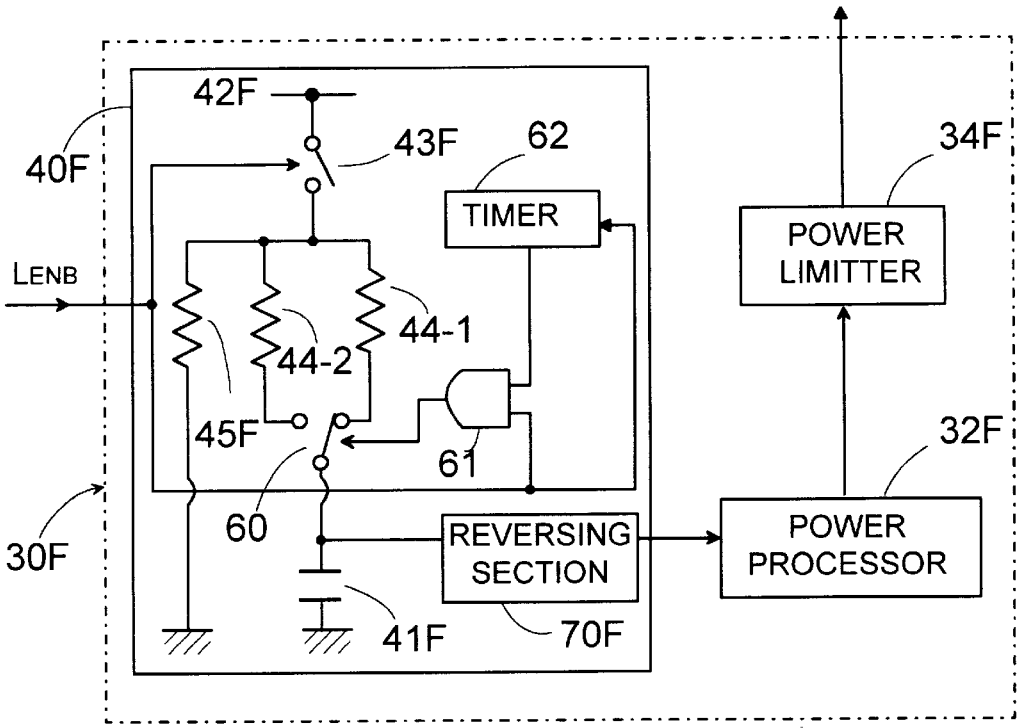
FIG. 12 is a block diagram of a power commander utilized in the ballast in accordance with the seventh embodiment of the present invention.

Seventh Embodiment <FIG. 12>

FIG. 12 illustrates a ballast in accordance with a seventh embodiment of the present invention which is identical to the first embodiment except for the configuration of a function generator 40F. Like parts are designated by like numerals with a suffix letter of "F". The function generator 40F includes a fixed power source 42F, and a parallel combination of a first resistor 44-1 and a second resistor connected 44-2 in series with switches 43F and 60 between the power source 42F and a capacitor 41F. The first resistor 44-1 is selected to have a high impedance or resistance than the second resistor 44-2. The switch 60 is normally set to connect the first resistor 44-1 of high resistance to the capacitor 41F, and is controlled by a timer 62 through an AND gate 61 so as to connect the second resistor 44-2 of low resistance after a predetermined period from the energization of the ballast. Upon receiving the lighting enable signal $L_{ENB}$, the switch 43F is closed to charge the capacitor 41F by the power source 42F through the first resistor 44-1. At this occurrence, the timer 62 starts counting time and provide a set signal to one input of AND gate 61 after the elapse of the predetermined time period. The AND gate 61, which has the other input end receiving the light signal, responds to give an output of turning the switch 60 for switching the first resistor 44-1 to second resistor 44-2, thereby changing the impedance to the charging current and therefore changing the charging rate of charging capacitor 41F. Consequently, the like charging curve and the reference curve as shown in FIGS. 2A and 2B are obtained in which the inflection point is given at a timing of switching the first to the second resistor. It is noted in this connection that the turn-over of the switch 60 may be made based upon the detected charged voltage as seen in the second embodiment or based upon the maximum power rating as seen in the sixth embodiment.

Figure 13:
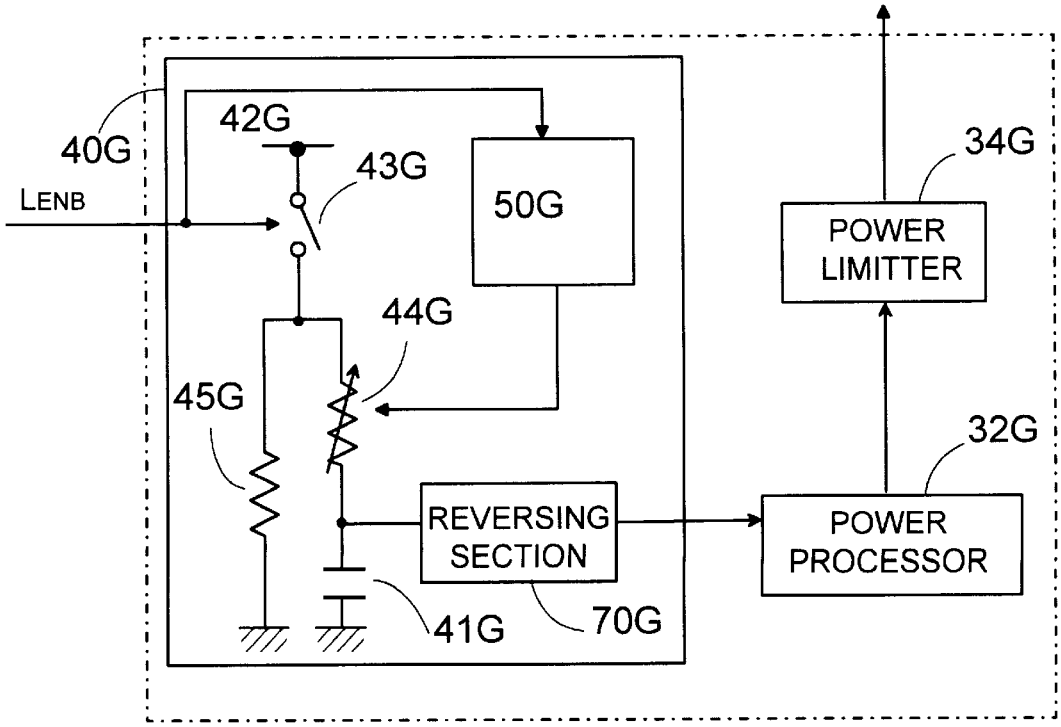
FIG. 13 is a block diagram of a power commander utilized in the ballast in accordance with the eighth embodiment of the present invention.

Eighth Embodiment <FIG. 13>

FIG. 13 illustrates a ballast in accordance with an eighth embodiment of the present invention which is identical to the first embodiment except for the configuration of a function generator 40G. Like parts are designated by like numerals with a suffix letter of "G". The function generator 40G includes a variable resistor 44G connected in series with a switch 43G between a fixed power source 42G and a capacitor 41G. The variable resistor 44G is controlled by a time-varying function circuit 50G to vary its resistance for varying a charging rate of charging the capacitor 41G by the power source 42G. The time-varying function circuit 50G varies the resistance of the resistor 44G in such a manner as to give an abrupt change in the charging rate at a certain time after the energization of the ballast and therefore to give the inflection point on the resulting reference curve as shown in FIG. 2B. The switch 43G is closed and the function circuit 50G is activated simultaneously upon receiving the lighting enable signal $L_{ENB}$.

Figure 14:
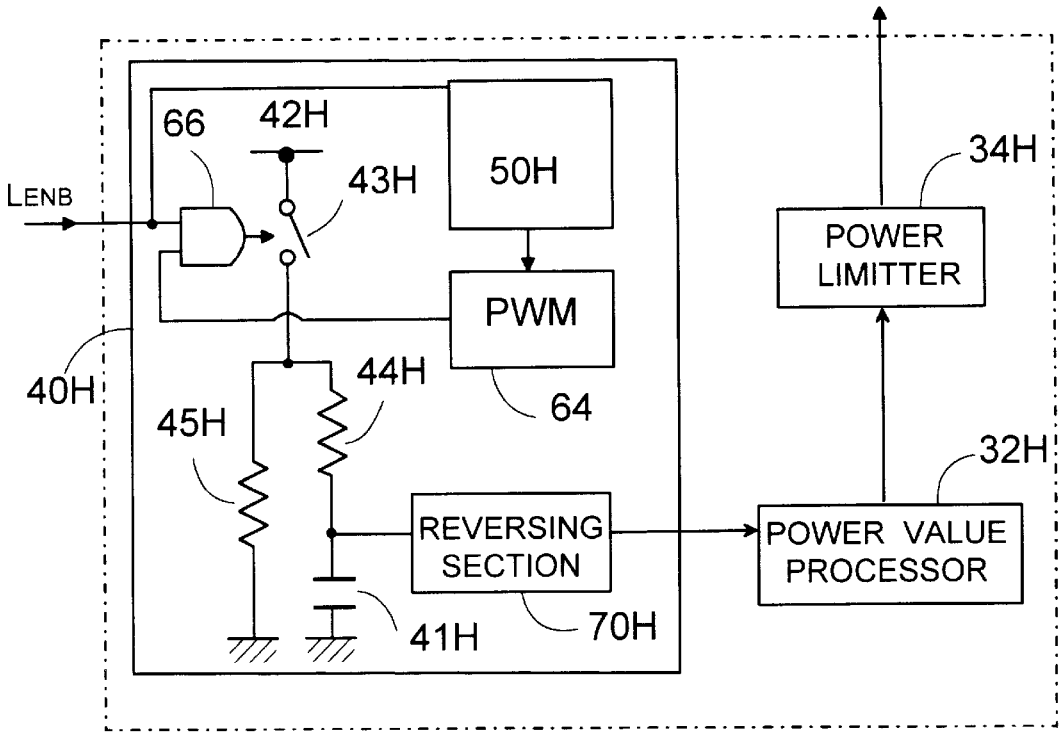
FIG. 14 is a block diagram of a power commander utilized in the ballast in accordance with the ninth embodiment of the present invention.
Figure 15A:
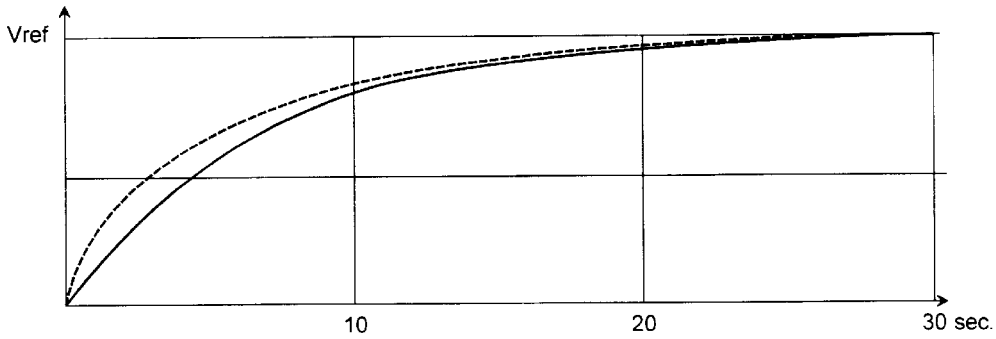
FIGS. 15A and 15B are graphs of a capacitor charging curve and a power curve applied to the discharge lamp for illustration of the background of the present invention.
Figure 15B:
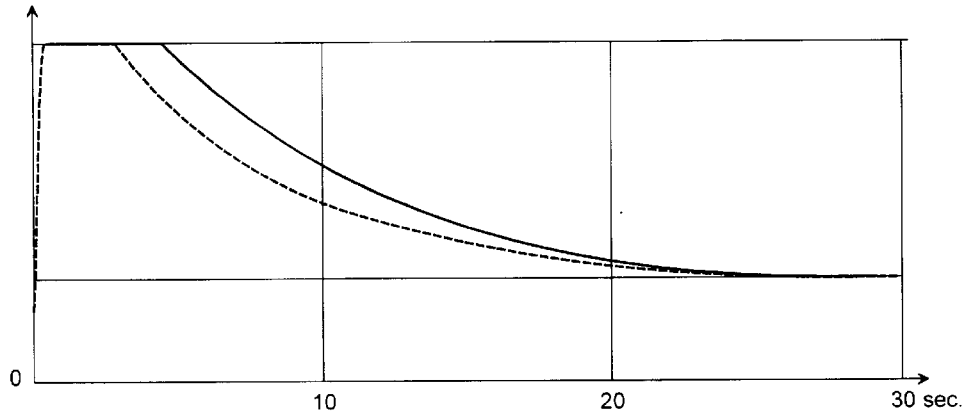
Figure 16:
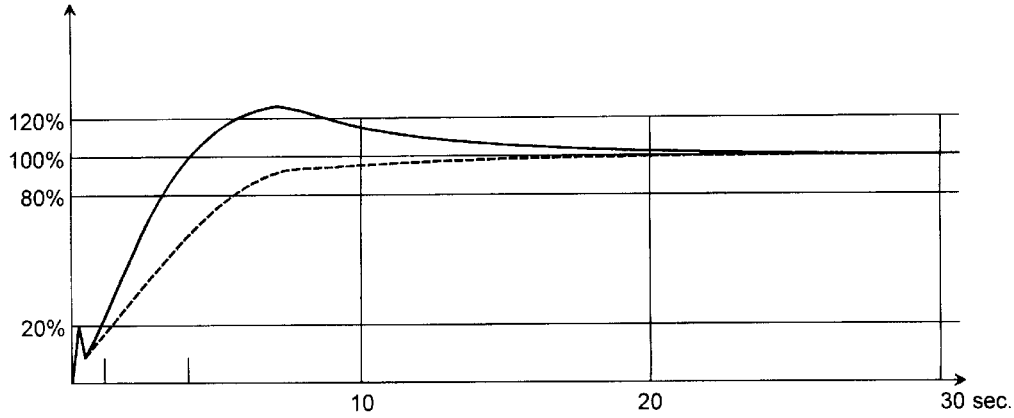
FIG. 16 is a graph of relative luminous flux for illustration of the background of the present invention in which the relative flux is represented by a percentage of the luminous flux in relation to the luminous flux attained after 3 minutes from the start of a discharge lamp.

Ninth Embodiment <FIG. 14>

FIG. 14 illustrates a ballast in accordance with a ninth embodiment of the present invention which is identical to the first embodiment except for the configuration of a function generator 40H. Like parts are designated by like numerals with a suffix letter of "H". The function generator 40H includes a PWM circuit 64 which provides a pulse width modulated signal to repetitively turning on and off a switch 43H for charging a capacitor 41H by a power source 42H. A time-varying function circuit 50H is connected to increase the duty cycle of the signal with time, thereby increasing a charging rate of the capacitor 41H with time. An AND gate 66 is provided to receive the lighting enable signal LENB as well as the modulate signal from the PWM circuit 64 so as to turn on and off the switch 43H at the presence of the lighting enable signal. The duty cycle of the signal is controlled at the function circuit 50H such that the charging curve sees an abrupt change to thereby give the inflection point on the resulting reference curve, as shown in FIGS. 2A and 2B, after a predetermined time period from the energization of the ballast.

What is claimed is:

1. A method of starting a discharge lamp having a normal power rating and a maximum power rating with the use of a ballast having a power converter capable of varying a power being applied to said discharge lamp within a range between said maximum power rating and said normal power rating, said method comprising:

varying said power being applied to the said discharge lamp along a particular run-up curve so as to apply said maximum power rating and subsequently apply the power of decreasing to the normal power rating;

said run-up curve being derived from a reference curve having a power level decreasing with time from the energization of said ballast;

said reference curve having a maximum value exceeding said maximum power rating, said reference curve having an inflection point near said maximum power rating so as to define a first reference curve above said inflection point and a second reference curve below said inflection point;

said first reference curve having a first average slope for a first reference time period from a point of said maximum value to said inflection point, said second reference curve having a second average slope for a second reference time period which starts from the inflection point and lasts for the same time interval as said first reference time period, said second average slope being greater than said first average slope;

said run-up curve being a continuous composite curve of a straight line of said maximum power rating defined by a portion thereof below said reference curve and the remainder of said reference curve defined between said maximum power rating and said normal power rating.

2. The method as set forth in claim 1, wherein said inflection point lies at said maximum power rating.

3. A ballast for operating a discharge lamp having a maximum power rating and a normal power rating, said ballast comprising:

a power converter capable of applying a varying power to discharge lamp;

a power commander which generates a particular run-up curve of the power with reference to time and which is connected to said power converter to vary the power along said run-up curve in a direction of decreasing from said maximum power rating to said normal power rating;

said run-up curve being derived from a reference curve which gives a power level decreasing with time from a maximum value to said normal power rating, said maximum value being obtained substantially immediately upon energization of said ballast, and said maximum value exceeding said maximum power rating; said reference curve having an inflection point near said maximum power rating so as to define a first reference curve above said inflection point and a second reference curve below said inflection point;

said first reference curve having a first average slope for a first reference time period from a point of said maximum value to said inflection point, and said second reference curve having a second average slope for a second reference time period which starts from the inflection point and lasts for the same time interval as said first reference time period, said second average slope being greater than said first average slope;

said run-up curve being a continuous composite curve of a straight line of said maximum power rating defined by a portion below said reference curve and the remainder of said reference curve defined between said maximum power rating and said normal power rating.

4. The ballast as set forth in claim 3, wherein said inflection point lies at said maximum power rating.

5. The ballast as set forth in claim 3, wherein said power commander includes a function generator having a capacitor, a power source and a regulator for charging said capacitor at different rates to give a charging curve, said reference curve being defined as a reversal of the charging curve to have said inflection point on said reference curve where said charging rate changes critically.

6. The ballast as set forth in claim 3, wherein said power commander includes a function generator having a capacitor, and first and second power sources of different voltage levels for charging said capacitor at a different rate, said second power source having a higher supplying voltage than said first power source, said reference curve being a reversal of a curve of charging the capacitor so that said inflection point is defined at a point of switching said first power source to said second power source for charging said capacitor.

7. The ballast as set forth in claim 6, wherein said function generator includes a timer which is responsible for switching said first power source to said second power source at a predetermined time from the energization of the ballast.

8. The ballast as set forth in claim 6, wherein said function generator includes a comparator which compares a voltage being developed across said capacitor with a reference voltage so as to switch said first power source to said second power source when said voltage across said capacitor exceeds said reference voltage.

9. The ballast as set forth in claim 6, wherein said power commander includes a limiter which receives said reference curve and limits the reference curve below said maximum power rating to provide said run-up curve, said function generator includes a comparator which compares the power level on said reference curve input to said limiter with said maximum power rating so as to switch said first power source to said second power source when the power level on said reference curve decreases to said maximum power rating.

10. The ballast as set forth in claim 3, wherein said power commander includes a function generator having a capacitor, and a variable power source providing a variable voltage increasing from a first level to a second level for charging said capacitor at a varying rate, said reference curve being a reversal of a curve of charging the capacitor so that said inflection point is defined at a point of said variable voltage increasing to said second voltage level.

11. The ballast as set forth in claim 10, wherein said function generator includes a timer for causing said variable voltage to be fixed to said second level at a predetermined time after the energization of the ballast.

12. The ballast as set forth in claim 10, wherein said variable power source is regulated by a charging voltage across said capacitor so as to increase with said charging voltage and is fixed to said second level after said charging voltage reaches to a predetermined value.

13. The ballast as set forth in claim 3, wherein said power commander includes a function generator having a capacitor, a first variable power source and a second fixed power source each providing a voltage for charging said capacitor, said second fixed power source having a higher supplying voltage than said first variable power source, said reference curve being a reversal of a curve of charging the capacitor so that said inflection point is defined at a point of switching said first variable power source to said second fixed power source for charging said capacitor, said first variable power source providing the voltage which varies in such a manner as to provide said first reference curve of substantially straight.

14. The ballast as set forth in claim 3, wherein said power commander includes a function generator having a capacitor, a variable impedance element, and a single power source providing a voltage for charging said capacitor through said variable impedance at a varying rate, said variable impedance element giving a first impedance and a second impedance smaller than said first impedance, said reference curve being a reversal of a curve of charging the capacitor through said impedance element, and said inflection point being defined at a point of switching said first impedance to said second impedance.

15. The ballast as set forth in claim 14, wherein said variable impedance element comprises a parallel combination of a first resistor and a second resistor connected in series between said power source and said capacitor, said first and second resistors giving said first and second impedances, respectively, said function generator further including a timer which is responsible for switching said first resistor to said second resistor for connection with the capacitor at a predetermined time from the energization of said ballast.

16. The ballast as set forth in claim 14, wherein said variable impedance element is a single variable resistor.

17. The ballast as set forth in claim 3, wherein said power commander includes a function generator having a capacitor, a power source providing a voltage for charging said capacitor such that said reference curve is defined as a reversal of a curve of charging the capacitor, said function generator further including a switch inserted between said power source and said capacitor, a PWM circuit providing a PWM signal for driving said switch to turn on and off repetitively, and a timer connected to said PWM driver to increase the duty cycle of the PWM signal from the energization of the ballast in such a manner as to give said inflection point on said reference curve.

18. A ballast for operating a discharge lamp having a maximum power rating and a normal power rating, said ballast comprising:

a power converter capable of applying a varying power to discharge lamp;

a power commander which generates a particular run-up curve of the power with reference to time and which is connected to said power converter to vary the power along said run-up curve in a direction of decreasing from said maximum power rating to said normal power rating;

said run-up curve being derived from a reference curve which gives a power level decreasing with time from a maximum value to said normal power rating, said maximum value being obtained substantially immediately upon energization of said ballast, and said maximum value exceeding said maximum power rating; said reference curve having an inflection point near said maximum power rating so as to define a first reference curve above said inflection point and a second reference curve below said inflection point;

said first reference curve having a first average slope for a first reference time period from a point of said maximum value to said inflection point, and said second reference curve having a second average slope for a second reference time period which starts from the inflection point and lasts for the same time interval as said first reference time period, said second average slope being greater than said first average slope;

said run-up curve being a continuous composite curve of a straight line of said maximum power rating defined by a portion below said reference curve and the remainder of said reference curve defined between said maximum power rating and said normal power rating;

said power commander includes a function generator having a capacitor, and first and second power sources of different voltage levels for charging said capacitor at a different rate, said second power source having a higher supplying voltage than said first power source, said reference curve being a reversal of a curve of charging the capacitor so that said inflection point is defined at a point of switching said first power source to said second power source for charging said capacitor, and said function generator further including a discharge path for discharging said capacitor when said discharge lamp is turned off.

* * * * *